United States Patent [19]

Röck et al.

[11] 4,255,002

[45] Mar. 10, 1981

[54] PULL-OUT GUIDE FOR DRAWERS

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 22,359

[22] Filed: Mar. 20, 1979

[30] Foreign Application Priority Data

Mar. 30, 1978 [AT] Austria ..... 2221/78

[51] Int. Cl.³ ..... A47B 88/16; F16C 21/00

[52] U.S. Cl. ..... 312/348; 308/3.6; 312/342; 312/345

[58] Field of Search ..... 312/333, 341 R, 343, 312/345, 348, 350; 308/3.6, 3.8

[56] References Cited

U.S. PATENT DOCUMENTS

| | | | |
|---|---|---|---|
| 3,142,517 | 7/1964 | Ward | 308/3.6 |
| 4,004,841 | 1/1977 | Vanderley | 312/348 |
| 4,089,567 | 5/1978 | | 308/3.6 |
| 4,101,178 | 7/1978 | Adams et al. | 312/348 |

FOREIGN PATENT DOCUMENTS

| | | |
|---|---|---|
| 2,601,670 | 7/1977 | W. Germany |

*Primary Examiner*—Casmir A. Nunberg
*Attorney, Agent, or Firm*—Wenderoth, Lind & Ponack

[57] ABSTRACT

A withdrawal guide for drawers or the like, where the drawer has two external sides, for use in a fixed structure, the latter having two internal sides, includes two support rails disposed on each of the fixed structure sides, respectively, two guide rails disposed on the external sides of the drawer, respectively, and two mobile units. Each mobile unit includes at least two rollers. The rollers are supported between a corresponding guide and support rail for taking up vertical forces. The support rails and/or the guide rails having a stop for the mobile units. Each mobile unit is formed with at least one clamping means being a fixed part of the mobile unit, co-acting with the track in which the mobile unit is held, when the drawer is pulled out from the fixed structure for securing the mobile unit in the inward-movable direction of the withdrawal guide.

20 Claims, 5 Drawing Figures

PULL-OUT GUIDE FOR DRAWERS

BACKGROUND OF THE INVENTION

1. Field of the Invention

The invention relates to a pull-out guide for drawers or the like and includes one supporting rail and one pull-out rail on each side of the drawer and at least two rollers or the like transmitting vertical forces arising between the pull-out rail and the supporting rail and being mounted in a roller carrier in the form of a carriage. The carriage is provided with locking means which lock the carriage in the push-in direction of the pull-out guide, when the pull-out rail is pulled free of the supporting rail.

2. Description of the Prior Art

Such pull-out guides are widely used with drawers, shelves and the like in modern furniture production, particularly in kitchen furniture production.

In general the purpose of such guides is to facilitate the moving of the drawer and to avoid any obstructions during this movement.

In addition to known drawer guides, which comprise rollers or slides, the rollers and slides being fixed directly to the supporting and pull-out rails, an increasing number of pull-out guides for drawers have been used lately in which, as mentioned above, the rollers are carried by a cage or the like and float between the supporting and pull-out rails.

SUMMARY OF THE INVENTION

It is the object of the present invention to provide a pull-out guide of the above-mentioned kind in which the carriage is locked, when the drawer is pulled out, so that the carriage cannot unintentionally move forward or backward in the rail and that the carriage is prevented from tilting sideways, out of the rail it runs in, when a U-shaped profile rail is used.

By means of the present invention high operational reliability may be obtained and it is possible to omit movable parts in the prior art securing mechanism.

It is very important to prevent the carriage from tilting laterally. In general, the rail in which the carriage is guided, which rail can either be the pull-out rail or the supporting rail, has a C-shaped profile, whereby the outer edges of the rail embrace the carriage, thus holding the carriage securely in the rail. It is a disadvantage of this arrangement, that the production of C-shaped profile rails requires complicated machines. Such a profile cannot be produced by means of a simple press, at least not in one operating cycle, because of the inward bent edges of the C-shaped profile rail.

According to the invention securing of the carriage is achieved by providing a cam or the like preferably disposed centrally on the carriage, such cam resting against the supporting flange of the rail taking up said carriage and said carriage being tiltable around said cam, whereby two parallel flanges are provided on the upper edge of the carriage, such flanges taking up between each other a projection of the rail, when the carriage is tilted around the cam, the projection being formed, for example, by an angled part of the upper horizontal flange of the rail.

It is preferably provided that one cam is provided on the lower side and one cam on the upper side of the carriage, the cams lying opposite each other, the upper cam corresponding with a lateral stop of the rail, thereby obtaining a good guiding of the carriage.

When the drawer is pulled free of the cabinet, the carriage is secured against tilting, also if the rail has a U-shaped profile and not a C-shaped profile. It can preferably be provided that at least one flange is spring mounted, so that it is laterally pressed against the angled part of the upper horizontal flange. A clamping effect is obtained thereby, which improves the holding of the carriage.

Preferably, a projection is formed on the carriage diametrically opposite the flanges. near to its front and rear end, a tilting of the carriage around a vertical axis is prevented.

BRIEF DESCRIPTION OF THE DRAWINGS

In the following an embodiment of the invention will be described in more detail with reference to the drawings, without being limited thereto, wherein.

DESCRIPTION OF THE PREFERRED EMBODIMENT

Figure 1:
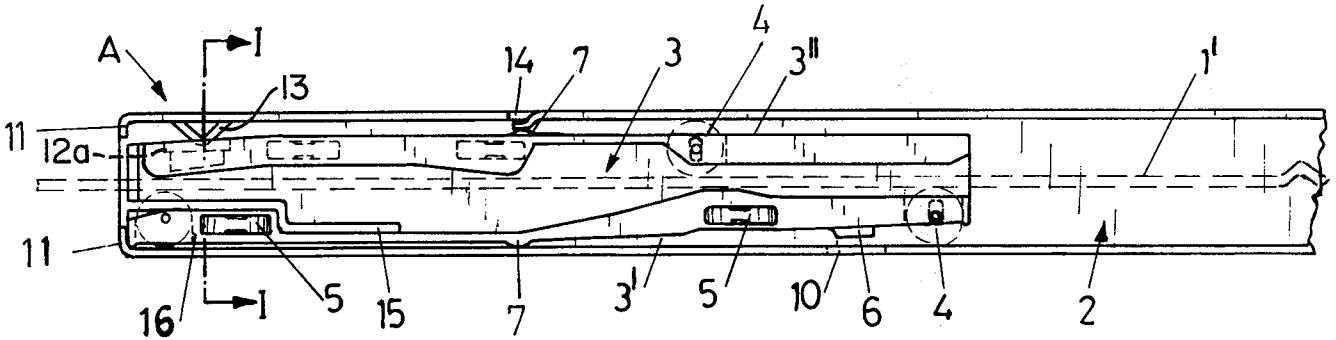
FIG. 1 is a schematic side view of a pull-out guide in accordance with the present invention, wherein the drawer is shown pushed in, wherein only the carriage and the rail taking up the carriage are shown, and wherein the rail guided within the carriage by means of a flange is shown with dotted lines for the purpose of better illustration.

The pull-out guide in accordance with the present invention substantially comprises a supporting rail 1 on the side of a body, e.g., a furniture body, a pull-out rail 2 on the side of a drawer to fit into the body, and a carriage 3, pull-out rail 2 providing a horizontal channel within the drawer as illustrated, or alternatively within the body, for housing carriage 3. Load-transmitting rollers 4 are mounted in the carriage 3.

It is an essential feature of the present invention that the rail in which the carriage 3 is guided may be either the pull-out rail or the supporting rail. It is essential that one rail takes up the carriage, while the second rail, i.e., the supporting rail 1 on the side of the body according to the present illustrated embodiment, projects with a horizontal flange 1' between the rollers 4 of the carriage 3.

In illustrated embodiment the rollers 4 are mounted with clearance and without axles in the carriage 3, i.e. corresponding recesses and projections are laterally disposed in the carriage 3 and on the rollers 4, whereby the rollers 4 are kept in the carriage 3, but can be moved to a certain extent, the roller 4 lying opposite a stop surface 9 at least to the height of a stop 8.

Also disposed in the carriage 3 are lateral compensating rollers 5 which are mounted in the same way as the rollers 4 and improve the lateral guiding of the drawer.

Figure 3:
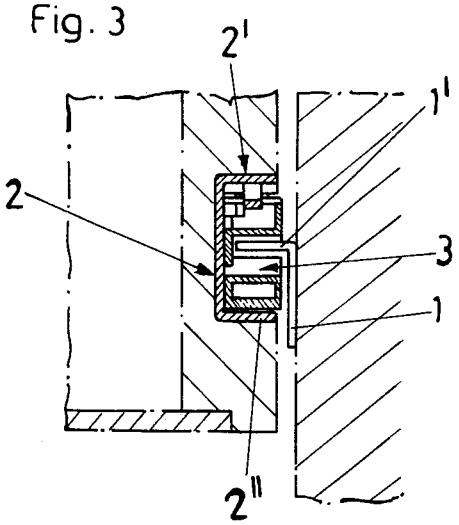
FIG. 3 is a sectional view along line I—I of FIG. 1.
Figure 4:
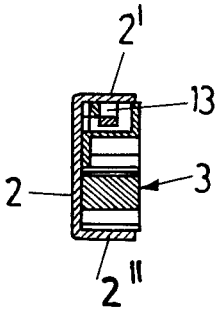
FIG. 4 is a sectional view along line II—II of FIG. 2.

As can be seen in FIG. 3, the pull-out rail 2 on the side of the drawer has a U-shaped profile, and the supporting rail 1 on the side of the body has an L-shaped profile. The body and the drawer are indicated in this figure by dots and dashes. As already mentioned, the carriage 3 of this embodiment is guided in the pull-out rail 2 on the side of the drawer.

The carriage 3 has a projection 6 near its front end serving as a lock and extending into a recess 10 in the lower horizontal flange 2'' of the pull-out rail 2, when the drawer is pulled out of the pull-out guide.

In the illustrated embodiment cams 7 are disposed approximately in the center of the carriage 3 on its upper side 3'' as well as on its lower side 3', the carriage 3 being tiltable around cams 7. The cams 7 are adapted to slide or almost slide on the two parallel flanges 2', 2'' of the pull-out rail.

When the drawer is pushed into the body, i.e. when the horizontal flange 1' of the supporting rail 1 is positioned between the rollers 4, the projection 6 is, as shown in FIG. 1, positioned within the U-shaped profile of the pull-out rail 2, and the carriage 3 is freely movable on the supporting rail 1 and in the pull-out rail 2.

Figure 2:
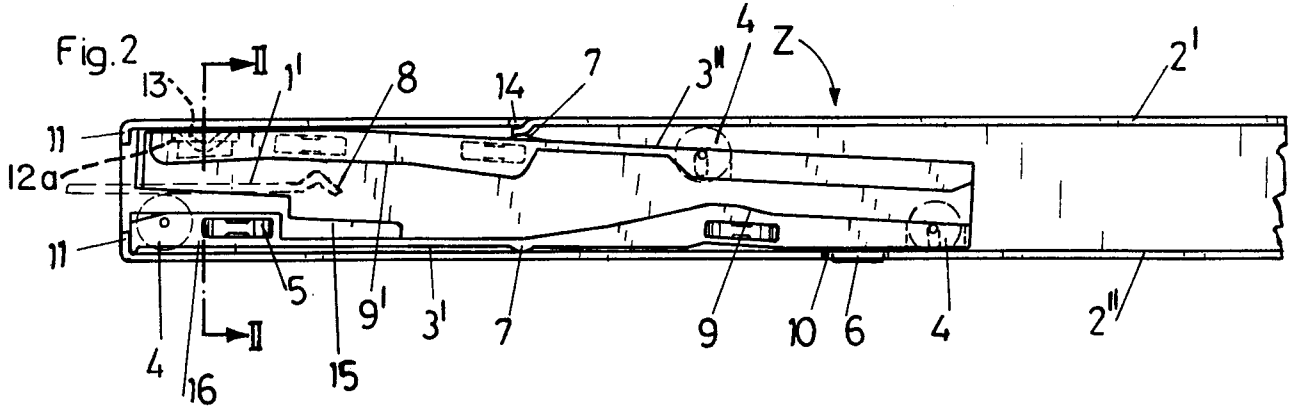
FIG. 2 is a view similar to FIG. 1, but with the drawer shown pulled out.

At the front end of the supporting rail 1, a stop 8 is preferably disposed on the horizontal flange 1', as indicated in FIG. 2. Stop 8 can, for example, be bent out of the horizontal flange 1' of the supporting rail 1.

When the drawer is pulled in the direction toward the right side of FIGS. 1 and 2, the horizontal flange 1' of the supporting rail 1 is successively pressed against stop surfaces 9, 9' of the carriage 3. Thereby the carriage 3 is tilted around the lower cam 7 in the direction of arrow Z, and the projection 6 is pressed into the recess 10 of the pull-out rail 2. This process obviously only takes place when the carriage 3 is positioned at the rearmost end of the pull-out rail 2, i.e. in the position shown in FIGS. 1 and 2. The further pulling out of the carriage 3 during the pulling of the drawer is prevented by means of stops 11.

Figure 5:
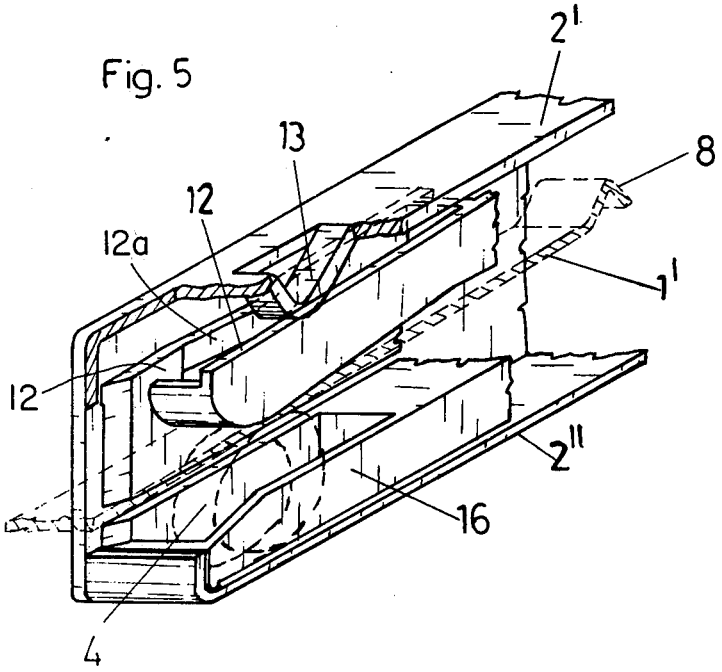
FIG. 5 is a perspective view of section A of FIG. 1.

When the carriage 3 is tilted around the cam 7, not only the projection 6 engages with the recess 10, but two parallel flanges 12 of the carriage 3 are also lifted and take up between each other an angled part or projection 13 of the upper horizontal flange 2' of the pull-out rail, as can be seen particularly in FIG. 5. As the carriage 3 is made of plastic, one of the two parallel flanges 12 is spring portion 12*a* which is resiliently biased or mounted and bent towards the other parallel flange 12, as shown in FIG. 5, the carriage 3 is clamped to the angled part 13.

The upper horizontal flange 2' of the pull-out rail 2 is preferably provided with a further angled part 14 laterally contacting the upper cam 7 of the carriage 3, so that the carriage is absolutely secured against lateral tilting.

The releasing of the carriage 3 is automatically effected by moving the horizontal flange 1' into the carriage 3 when the drawer is moved into the horizontal level thereof.

As can particularly be seen in FIGS. 1 and 2, the carriage 3 has a step-shaped separating slot 15, which separates a portion 16 of the carriage 3 carrying one roller 4 from the rest of the carriage 3. As the carriage 3 is made of plastic, portion 16 and the roller 4 are thus resiliently biased or spring mounted with respect to the remainder of carriage 3, i.e. when pushing the drawer onto the supporting rail 1, the roller 4 can evade the stop, thereby preventing the carriage 3 from being pushed down by the angled part 13 on which it is supported by means of flanges 12, and enables the carriage to freely move onto the rail.

What is claimed is:

1. A pull-out guide assembly for use on each of opposite sides of a drawer in an article of furniture of the type wherein a drawer is slidably insertable and removable from a furniture body, said pull-out guide assembly comprising:

means associated with the drawer for forming a horizontal channel defined by upper and lower spaced horizontal surfaces;

a supporting rail adapted to be mounted on the body, said supporting rail having a horizontal flange adapted to extend outwardly from the body and into said channel between said upper and lower channel surfaces;

at least two roller means, positioned for rolling contact on said flange and said upper and lower channel surfaces for taking up vertical forces between said supporting rail and said means forming said channel when the drawer is positioned within the body;

said roller means being mounted within and supported by a carriage which is mounted within said channel and which is longitudinally movable with respect to said channel and said supporting rail;

said carriage, said channel and said flange being dimensioned such that said carriage is unitarily and completely tiltable in a single direction within said channel about a horizontal axis transverse to the longitudinal direction of said channel only when said supporting rail and said channel are relatively longitudinally moved to a maximum drawer pull-out position;

said carriage having adjacent a first end thereof locking means operable in cooperation with a first of said channel surfaces for locking said carriage within said channel only when said supporting rail and said channel are moved to said maximum drawer pull-out position; and said carriage having adjacent a second end thereof clamping means for laterally grasping opposite sides of a projection extending into said channel from a second of said channel surfaces only when said supporting rail and said channel are moved to said maximum drawer pull-out position.

2. An assembly as claimed in claim 1, wherein said carriage is tiltable about cams extending from upper and lower surfaces of said carriage.

3. An assembly as claimed in claim 2, wherein said second channel surface has extending therefrom a second projection adapted to contact one of said cams when said carriage is tilted.

4. An assembly as claimed in claim 1, wherein said locking means comprises a projection extending from said first end of said carriage and adapted to fit within a recess in said first channel surface.

5. An assembly as claimed in claim 1, wherein said means forming said channel comprises a pull-out rail adapted to be mounted on the drawer.

6. An assembly as claimed in claim 1, wherein said clamping means comprises a pair of spaced vertical flanges integral with said carriage and positioned to receive therebetween said projection.

7. An assembly as claimed in claim 6, wherein a first said flange is resiliently biased toward a second said flange.

8. An assembly as claimed in claim 6, wherein said carriage includes at a portion thereof vertically spaced from said flanges, a carriage portion which is vertically resiliently movable with respect to the remainder of said carriage, one of said roller means being supported by said carriage portion.

9. An assembly as claimed in claim 8, wherein said carriage portion is separated from said flanges by a slot formed in said carriage.

10. An assembly as claimed in claim 9, wherein said slot is step-shaped.

11. A pull-out guide assembly for use on each of opposite sides of a drawer in an article of furniture of the type wherein a drawer is slidably insertable into and removable from a furniture body, said pull-out guide comprising:

a supporting rail and a pull-out rail adapted to be mounted on adjacent sides of the body and the drawer at positions to extend substantially horizontally and to be relatively longitudinally movable when the drawer is pushed into or pulled out from the body, said supporting rail and pull-out rail having respective vertically spaced and horizontally extending flanges;

at least two roller means, positioned for rolling contact on said horizontally extending flanges, for taking up vertical forces between said pull-out rail and said supporting rail when the drawer is positioned within the body;

said roller means being mounted within and supported by a carriage which is longitudinally movable with respect to said supporting and pull-out rails;

said carriage and said rails being dimensioned such that said carriage is unitarily and completely tiltable in a single direction with respect to said rails about a horizontal axis transverse to the longitudinal direction of said rails only when said supporting rail and said pull-out rail are relatively longitudinally moved to a maximum drawer pull-out position;

said carriage having adjacent a first end thereof locking means operable in cooperation with a first said flange of one of said rails for locking said carriage within said one rail only when said rails are moved to said maximum drawer pull-out position; and said carriage having adjacent a second end thereof clamping means for laterally clamping opposite sides of a projection extending from a second said flange of said one rail only when said rails are moved to said maximum drawer pull-out position.

12. An assembly as claimed in claim 11, wherein said one rail comprises said pull-out rail.

13. An assembly as claimed in claim 11, wherein said carriage is tiltable about cams extending from upper and lower surfaces of said carriage.

14. An assembly as claimed in claim 13, wherein said second flange has extending therefrom a second projection adapted to contact one of said cams when said carriage is tilted.

15. An assembly as claimed in claim 11, wherein said locking means comprises a projection extending from said first end of said carriage and adapted to fit within a recess in said first flange.

16. An assembly as claimed in claim 11, wherein said clamping means comprises a pair of spaced vertical flanges integral with said carriage and positioned to receive therebetween said projection.

17. An assembly as claimed in claim 16, wherein a first said flange is resiliently biased toward a second sand flange.

18. An assembly as claimed in claim 16, wherein said carriage includes, at a portion thereof vertically spaced from said pair of flanges, a carriage portion which is vertically resiliently movable with respect to the remainder of said carriage, one of said roller means being supported by said carriage portion.

19. An assembly as claimed in claim 18, wherein said carriage portion is separated from said pair of flanges by a slot formed in said carriage.

20. An assembly as claimed in claim 19, wherein said slot is step-shaped.

* * * * *